US009801450B1

(12) United States Patent
Reeg

(10) Patent No.: US 9,801,450 B1
(45) Date of Patent: Oct. 31, 2017

(54) NON-INVASIVE FACE-LIFTING ACCESSORY AND ASSOCIATED USE THEREOF

(71) Applicant: Siggy Reeg, West Babylon, NY (US)

(72) Inventor: Siggy Reeg, West Babylon, NY (US)

( * ) Notice: Subject to any disclaimer, the term of this patent is extended or adjusted under 35 U.S.C. 154(b) by 0 days.

(21) Appl. No.: 15/287,661

(22) Filed: Oct. 6, 2016

Related U.S. Application Data

(60) Provisional application No. 62/237,810, filed on Oct. 6, 2015.

(51) Int. Cl.
*A61F 5/08* (2006.01)
*A45D 44/22* (2006.01)

(52) U.S. Cl.
CPC ..... *A45D 44/22* (2013.01)

(58) Field of Classification Search
CPC ..... A45D 44/22
See application file for complete search history.

(56) References Cited

U.S. PATENT DOCUMENTS 5,582,585 A * 12/1996 Nash-Morgan ..... A45D 44/22 428/343
2009/0171385 A1* 7/2009 Karnwie-Tuah ..... A45D 44/22 606/204.35

FOREIGN PATENT DOCUMENTS

GB 191507913 * 0/1915
GB 901986 * 7/1962

* cited by examiner

*Primary Examiner* — Tuan V Nguyen

(57) ABSTRACT

A non-invasive face-lifting accessory includes an ear piece adapted to be positioned about an ear of the user, and a plurality of flexible fasteners detachably connected to the ear piece. Advantageously, the flexible fasteners are arranged in a non-overlapping configuration relative to the ear piece and adapted to be held in place on certain areas of the user facial skin for non-surgically lifting and pulling a user facial skin taut, thereby creating a more youthful appearance.

2 Claims, 6 Drawing Sheets

NON-INVASIVE FACE-LIFTING ACCESSORY AND ASSOCIATED USE THEREOF

CROSS REFERENCE TO RELATED APPLICATIONS

This is a non-provisional patent application that claims the benefit of U.S. provisional patent application No. 62/237,810 filed Oct. 6, 2015, which is incorporated by reference herein in its entirety.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND

Technical Field

Exemplary embodiment(s) of the present disclosure relate to non-invasive beauty products and, more particularly, to a non-invasive face-lifting accessory including transparent and various skin-tone colored soft, flexible, hypoallergenic tape, to be held in place on certain areas of the face, via a set of comfortable anchor-like earpieces for providing a non-surgical means of lifting or pulling the skin taut, creating a more youthful appearance in the face.

Prior Art

Perhaps one of the most popular medical procedures utilized today as a means of tightening the skin and creating a more youthful appearance is a facelift. Designed to take years off a patient's appearance, facelift surgery, or "rhytidectomy," can have excellent results if proper technique and planning are employed. Although there are a wide variety of facelift procedures available, the most common procedures involve undermining and dissecting the facial skin away from the tissues that lie directly beneath, with this skin then pulled upwards and back and reattached beneath the hairline. In this manner, the skin is pulled taut, with the formerly sagging brow line, crows-feet and other wrinkles and signs of aging vastly reduced or diminished altogether.

While there is little dispute that a facelift can indeed turn back the hands of time, a facelift is a serious and invasive medical procedure and one which should not be taken lightly or without careful consideration. Often resulting in a painful recovery period, extensive bruising and swelling, a facelift, as with any surgical procedure, can result in dangerous complications that can even threaten the patient's life. In addition to health risks, another very real dilemma associated with facelifts has to do with the end result of the procedure.

Specifically, should the surgeon pull the face too tight or apply too much filler to the skin, the result can be an overworked and freakish appearance. Flip through the pages of any gossip magazine or celebrity website and one is sure to see more than a few Hollywood stars who have had so much facial work that they are nearly unrecognizable, much less beautiful and youthful looking. Further, a facelift procedure can be extremely expensive. Typically costing several thousand dollars, a facelift is simply not an option for many consumers, particularly during these trying economic times.

Accordingly, a need remains for a non-invasive face-lifting accessory in order to overcome at least one aforementioned shortcoming. The exemplary embodiment(s) satisfy such a need by providing a non-invasive face-lifting accessory including transparent and various skin-tone colored soft, flexible, hypoallergenic tape, to be held in place on certain areas of the face, via a set of comfortable anchor-like earpieces that is convenient and easy to use, lightweight yet durable in design, versatile in its applications, and designed for providing a non-surgical means of lifting or pulling the skin taut, creating a more youthful appearance in the face.

BRIEF SUMMARY OF NON-LIMITING EXEMPLARY EMBODIMENT(S) OF THE PRESENT DISCLOSURE

In view of the foregoing background, it is therefore an object of the non-limiting exemplary embodiment(s) to provide a non-invasive face-lifting accessory for non-surgically lifting and pulling a user facial skin taut, thereby creating a more youthful appearance. These and other objects, features, and advantages of the non-limiting exemplary embodiment(s) are provided by a non-invasive face-lifting accessory including an ear piece adapted to be positioned about an ear of the user, and a plurality of flexible fasteners detachably connected to the ear piece. Advantageously, the flexible fasteners are arranged in a non-overlapping configuration relative to the ear piece and adapted to be held in place on certain areas of the user facial skin for non-surgically lifting and pulling a user facial skin taut, thereby creating a more youthful appearance.

In a non-limiting exemplary embodiment, the ear piece has a hook shape.

In a non-limiting exemplary embodiment, the hook shape includes a single and unitary body.

In a non-limiting exemplary embodiment, the single and unitary body includes a centrally registered latitudinal axis, a curvilinear top portion extending upwardly away from the centrally registered latitudinal axis, the curvilinear top portion including a substantially U-shape, and a curvilinear bottom portion extending downwardly away from the centrally registered latitudinal axis and opposite faced from the curvilinear top portion. Advantageously, the curvilinear bottom portion is integral with the curvilinear top portion.

In a non-limiting exemplary embodiment, the single and unitary body further includes a centrally registered longitudinal axis, a proximal end positioned at a first terminal end of the curvilinear top portion, and a distal end position at a second terminal end of the curvilinear bottom portion. In this manner, the distal end is axially offset from the proximal end relative to the centrally registered longitudinal axis.

In a non-limiting exemplary embodiment, the fasteners include a plurality of resilient, hypoallergenic tabs having an adhesive inner face capable of being removably affixed to certain areas of the user face adjacent to the user ear.

In a non-limiting exemplary embodiment, each of the tabs includes a linear first section having a proximal tip and an axially opposed distal tip, and a circular second section having a circumferential outer edge monolithically coupled to the distal tip. Advantageously, each of the tabs are deformably bent at the proximal tip relative to the ear piece.

In a non-limiting exemplary embodiment, the tabs include a first tab removably reattached to the curvilinear top portion adjacent to the proximal end of the single and unitary body, and a second tab removably reattached to the curvilinear bottom portion at the proximal end of the single and unitary body.

In a non-limiting exemplary embodiment, the tabs further include a third tab removably reattached to the curvilinear top portion approximately diametrically opposed to the proximal end of the single and unitary body wherein the third tab extends oppositely away from the first tab. Advantageously, the first tab is coextensively shaped to the second tab and the third tab.

The present disclosure further includes a method of utilizing a non-invasive face-lifting accessory for non-surgically lifting and pulling a user facial skin taut, thereby creating a more youthful appearance. Such a method includes the steps of: providing an ear piece; providing and detachably connecting a plurality of flexible fasteners to the ear piece such that the flexible fasteners are arranged in a non-overlapping configuration relative to the ear piece; positioning the ear piece about an ear of the user; and non-surgically lifting and pulling a user facial skin taut adjacent to a cheek bone and a jaw bone of the user by affixing the flexible fasteners to areas of the user facial skin adjacent to the ear of the user while the ear piece is positioned about the ear of the user.

There has thus been outlined, rather broadly, the more important features of non-limiting exemplary embodiment(s) of the present disclosure so that the following detailed description may be better understood, and that the present contribution to the relevant art(s) may be better appreciated. There are additional features of the non-limiting exemplary embodiment(s) of the present disclosure that will be described hereinafter and which will form the subject matter of the claims appended hereto.

BRIEF DESCRIPTION OF THE NON-LIMITING EXEMPLARY DRAWINGS

The novel features believed to be characteristic of non-limiting exemplary embodiment(s) of the present disclosure are set forth with particularity in the appended claims. The non-limiting exemplary embodiment(s) of the present disclosure itself, however, both as to its organization and method of operation, together with further objects and advantages thereof, may best be understood by reference to the following description taken in connection with the accompanying drawings in which:

Figure 1:
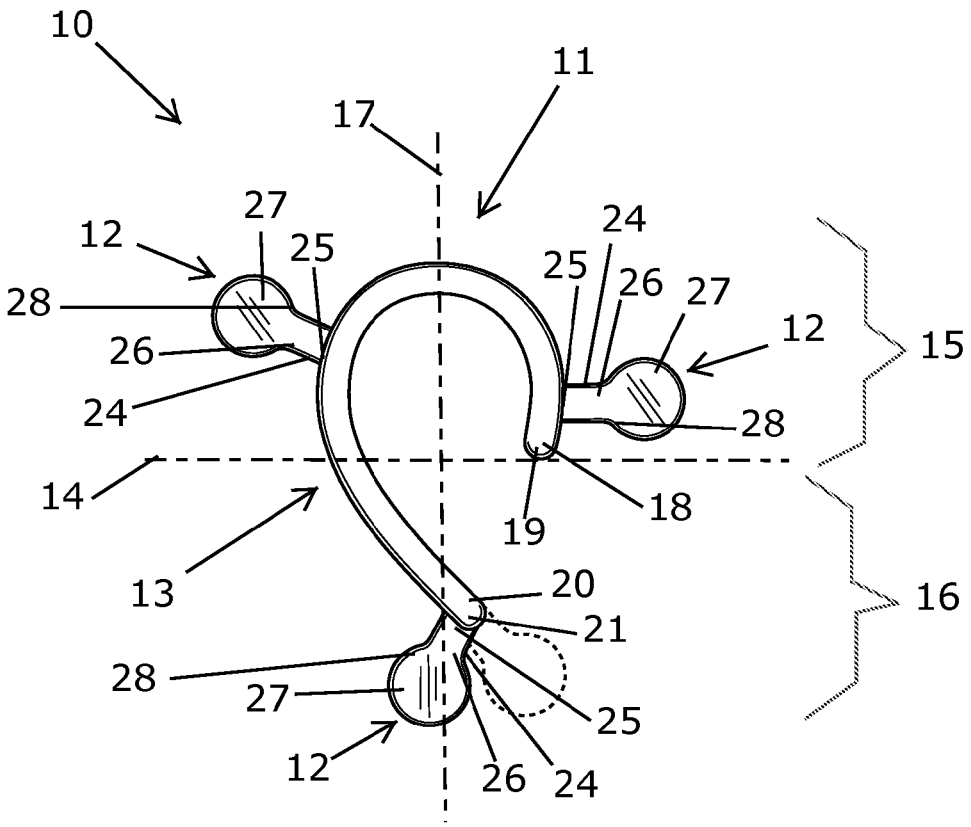
FIG. 1 is a front elevational view of a non-invasive face-lifting accessory for non-surgically lifting and pulling a user facial skin taut, thereby creating a more youthful appearance, in accordance with a non-limiting exemplary embodiment.
Figure 2:
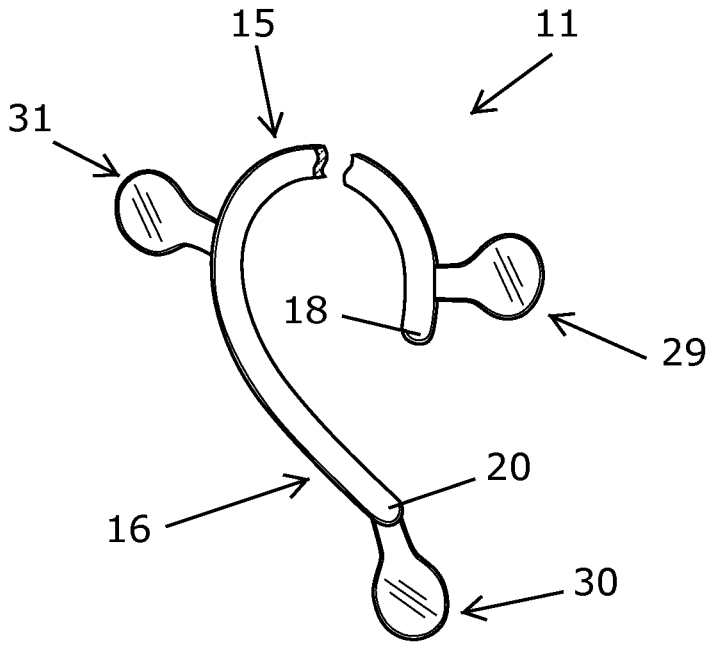
FIG. 2 is a break away view of the non-invasive face-lifting accessory shown in FIG. 1, and illustrating the unitary and single body construction.
Figure 3:
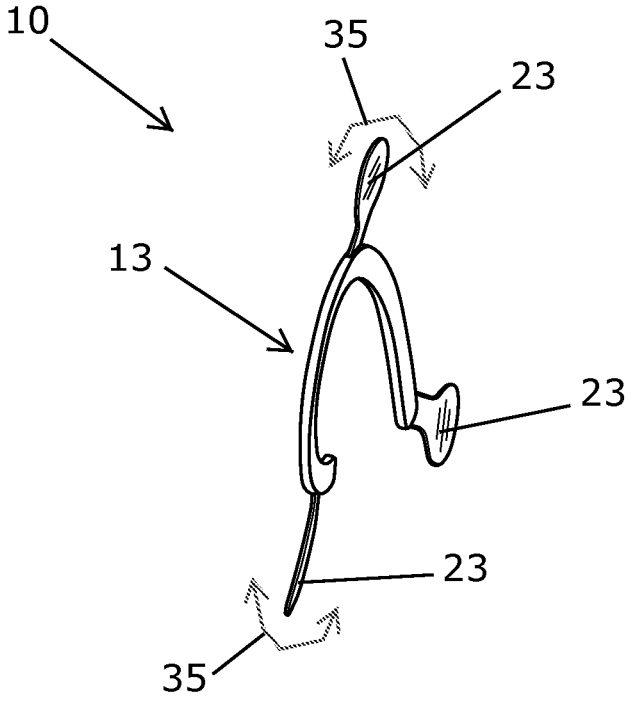
FIG. 3 is top plan view of the non-invasive face-lifting accessory shown in FIG. 1.
Figure 4:
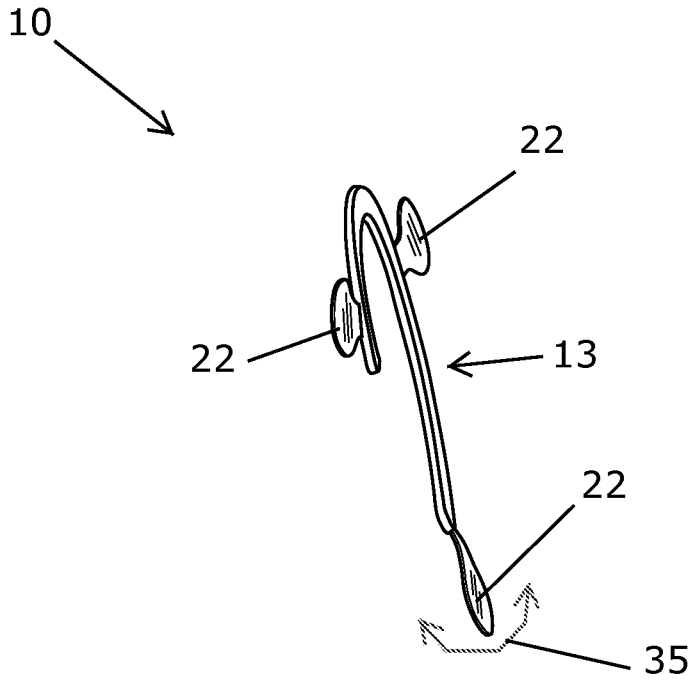
FIG. 4 is a right side elevational view of the non-invasive face-lifting accessory shown in FIG. 1.
Figure 5:
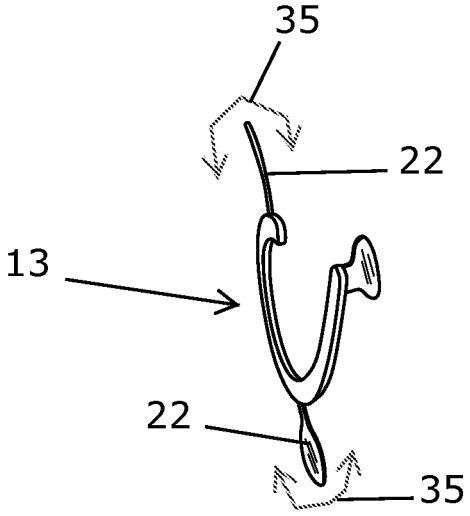
FIG. 5 is a bottom plan view of the non-invasive face-lifting accessory shown in FIG. 1.

Those skilled in the art will appreciate that the figures are not intended to be drawn to any particular scale; nor are the figures intended to illustrate every non-limiting exemplary embodiment(s) of the present disclosure. The present disclosure is not limited to any particular non-limiting exemplary embodiment(s) depicted in the figures nor the shapes, relative sizes or proportions shown in the figures.

DETAILED DESCRIPTION OF NON-LIMITING EXEMPLARY EMBODIMENT(S) OF THE PRESENT DISCLOSURE

The present disclosure will now be described more fully hereinafter with reference to the accompanying drawings, in which non-limiting exemplary embodiment(s) of the present disclosure is shown. The present disclosure may, however, be embodied in many different forms and should not be construed as limited to the non-limiting exemplary embodiment(s) set forth herein. Rather, such non-limiting exemplary embodiment(s) are provided so that this application will be thorough and complete, and will fully convey the true spirit and scope of the present disclosure to those skilled in the relevant art(s). Like numbers refer to like elements throughout the figures.

The illustrations of the non-limiting exemplary embodiment(s) described herein are intended to provide a general understanding of the structure of the present disclosure. The illustrations are not intended to serve as a complete description of all of the elements and features of the structures, systems and/or methods described herein. Other non-limiting exemplary embodiment(s) may be apparent to those of ordinary skill in the relevant art(s) upon reviewing the disclosure. Other non-limiting exemplary embodiment(s) may be utilized and derived from the disclosure such that structural, logical substitutions and changes may be made without departing from the true spirit and scope of the present disclosure. Additionally, the illustrations are merely representational are to be regarded as illustrative rather than restrictive.

One or more embodiment(s) of the disclosure may be referred to herein, individually and/or collectively, by the term "non-limiting exemplary embodiment(s)" merely for convenience and without intending to voluntarily limit the true spirit and scope of this application to any particular non-limiting exemplary embodiment(s) or inventive concept. Moreover, although specific embodiment(s) have been illustrated and described herein, it should be appreciated that any subsequent arrangement designed to achieve the same or similar purpose may be substituted for the specific embodiment(s) shown. This disclosure is intended to cover any and all subsequent adaptations or variations of other embodiment(s). Combinations of the above embodiment(s), and other embodiment(s) not specifically described herein, will be apparent to those of skill in the relevant art(s) upon reviewing the description.

References in the specification to "one embodiment(s)", "an embodiment(s)", "a preferred embodiment(s)", "an alternative embodiment(s)" and similar phrases mean that a particular feature, structure, or characteristic described in connection with the embodiment(s) is included in at least an embodiment(s) of the non-limiting exemplary embodiment(s). The appearances of the phrase "non-limiting exemplary embodiment" in various places in the specification are not necessarily all meant to refer to the same embodiment(s).

Directional and/or relationary terms such as, but not limited to, left, right, nadir, apex, top, bottom, vertical, horizontal, back, front and lateral are relative to each other and are dependent on the specific orientation of an applicable element or article, and are used accordingly to aid in the description of the various embodiment(s) and are not necessarily intended to be construed as limiting.

If used herein, "about" means approximately or nearly and in the context of a numerical value or range set forth means±15% of the numerical.

If used herein, "substantially" means largely if not wholly that which is specified but so close that the difference is insignificant.

The non-limiting exemplary embodiment(s) is/are referred to generally in FIGS. 1-6 and is/are intended to provide a non-invasive face-lifting accessory 10 for non-surgically lifting and pulling a user facial skin taut, thereby creating a more youthful appearance. The non-invasive face-lifting accessory 10 includes an ear piece 11 adapted to be positioned about an ear of the user, and a plurality of flexible fasteners 12 detachably connected to the ear piece 11. Advantageously, the flexible fasteners 12 are arranged in a non-overlapping configuration relative to the ear piece 11 and adapted to be held in place on certain areas of the user facial skin for non-surgically lifting and pulling a user facial skin taut, thereby creating a more youthful appearance. Such a structural configuration provides the unexpected and unpredictable advantage of ensuring the ear piece 11 maintains the skin taut (e.g., stretched and pulled).

In a non-limiting exemplary embodiment, the ear piece 11 has a hook shape thereby conforming to the outer contour of the user ear.

In a non-limiting exemplary embodiment, the hook shape includes a single and unitary body 13. Such a structural configuration provides the unexpected and unpredictable advantage of ensuring the ear piece 11 is not prematurely or undesirably warped from a desired shape after extended use.

In a non-limiting exemplary embodiment, the single and unitary body 13 includes a centrally registered latitudinal axis 14, a curvilinear top portion 15 extending upwardly away from the centrally registered latitudinal axis 14, the curvilinear top portion 15 including a substantially U-shape, and a curvilinear bottom portion 16 extending downwardly away from the centrally registered latitudinal axis 14 and opposite faced from the curvilinear top portion 15. Advantageously, the curvilinear bottom portion 16 is integral with the curvilinear top portion 15 thereby ensuring a long-lasting hook shape that is prohibited from being undesirably distorted so that the ear piece 11 lies substantially flat and maintains the user skin taut.

In a non-limiting exemplary embodiment, the single and unitary body 13 further includes a centrally registered longitudinal axis 17, a proximal end 18 positioned at a first terminal end 19 of the curvilinear top portion 15, and a distal end 20 position at a second terminal end 21 of the curvilinear bottom portion 16. In this manner, the distal end 20 is axially offset from the proximal end 18 relative to the centrally registered longitudinal axis 17. Such a structural configuration provides the unexpected and unpredictable advantage of ensuring the ear piece 11 maintains the skin taut (e.g., stretched and pulled) during extended use.

Figure 6:
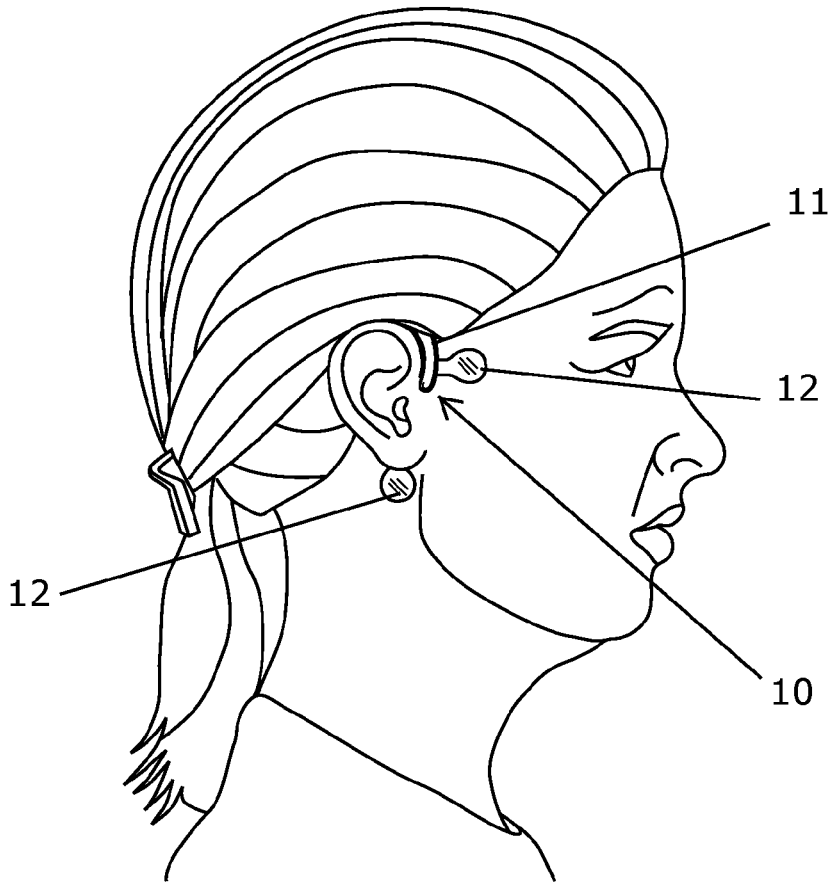
FIG. 6 is a front elevational view of the non-invasive face-lifting accessory, shown in FIG. 1, used in a preferred environment for non-surgically lifting and pulling a user facial skin taut, thereby creating a more youthful appearance.

In a non-limiting exemplary embodiment, the fasteners 12 include a plurality of resilient, hypoallergenic tabs 22 having an adhesive inner face 23 capable of being removably affixed to certain areas of the user face adjacent to the user ear (as best shown in FIG. 6). Such a structural configuration provides the unexpected and unpredictable advantage of enabling a user to calibrate and customize the accessory 10 to fit his/her face shape/size thereby ensuring the ear piece 11 maintains the skin taut (e.g., stretched and pulled).

In a non-limiting exemplary embodiment, each of the tabs 22 includes a linear first section 24 having a proximal tip 25 and an axially opposed distal tip 26, and a circular second section 27 having a circumferential outer edge 28 monolithically coupled to the distal tip 26. Advantageously, each of the tabs 22 are deformably bent (along arcuate paths 35) at the proximal tip 25 relative to the ear piece 11. Such a structural configuration provides the unexpected and unpredictable advantage of ensuring the ear piece 11 has sufficient surface area contact with the user skin thereby maintaining the skin taut (e.g., stretched and pulled).

In a non-limiting exemplary embodiment, the tabs 22 include a first tab 29 removably reattached to the curvilinear top portion 15 adjacent to the proximal end 18 of the single and unitary body 13, and a second tab 30 removably reattached to the curvilinear bottom portion 16 at the distal end 20 of the single and unitary body 13. Such a structural configuration provides the unexpected and unpredictable advantage of ensuring the ear piece 11 has sufficient surface area contact with the user skin thereby maintaining the skin taut (e.g., stretched and pulled).

In a non-limiting exemplary embodiment, the tabs 22 further include a third tab 31 removably reattached to the curvilinear top portion 15 approximately diametrically opposed to the proximal end 18 of the single and unitary body 13 wherein the third tab 31 extends oppositely away from the first tab 29. Advantageously, the first tab 29 is coextensively shaped to the second tab 30 and the third tab 31. Such a structural configuration provides the unexpected and unpredictable advantage of ensuring the ear piece 11 has sufficient surface area contact with the user skin thereby maintaining the skin taut (e.g., stretched and pulled).

The present disclosure further includes a method of utilizing a non-invasive face-lifting accessory 10 for non-surgically lifting and pulling a user facial skin taut, thereby creating a more youthful appearance. Such a method includes the steps of: providing an ear piece 11; providing and detachably connecting a plurality of flexible fasteners 12 to the ear piece 11 such that the flexible fasteners 12 are arranged in a non-overlapping configuration relative to the ear piece 11; positioning the ear piece 11 about an ear of the user; and non-surgically lifting and pulling a user facial skin taut adjacent to a cheek bone and a jaw bone of the user by affixing the flexible fasteners 12 to areas of the user facial skin adjacent to the ear of the user while the ear piece 11 is positioned about the ear of the user.

A non-limiting exemplary embodiment(s) of the present disclosure is referred to generally in FIGS. 1-6 and is intended to provide a non-invasive face-lifting accessory 10 including transparent and various skin-tone colored soft, flexible, hypoallergenic tape (tabs 22), to be held in place on certain areas of the face, via a comfortable anchor-like earpiece for providing a non-surgical means of lifting or pulling the skin taut, creating a more youthful appearance in the face. It should be understood that the exemplary embodiment(s) may be used with a variety of human faces, and should not be limited to any particular human face described herein.

Referring to the FIGS. 1-6 general, in a non-limiting exemplary embodiment(s), the non-invasive face-lifting accessory 10 is a specially designed line of adhesive easily applied to specific points on the face which serves to pull the facial skin up and back, improving one's overall appearance by creating the illusion of tight and smooth skin. The non-invasive face-lifting accessory 10 preferably includes at least one, an optionally, a pair of clear, plastic ear hooks (ear piece 11), similar to a headset or BLUETOOTH® earbud. The transparent, breathable hypoallergenic adhesive tabs 22 may be cut to a desired or needed strip length by the user, and placed in either one or both of the common pull points: slightly above either cheekbone and/or behind and above either or both jawbones. The tape (tabs 22) can be detachably connected to the wearable ear piece 11 hook, discreetly creating taut skin in these areas. This practice ensures stability and continued uplift of skin. For public sale, the non-invasive face-lifting accessory 10 may be sold in sets containing a roll of adhesive and up to ten ear pieces 11, for example.

The non-invasive face-lifting accessory 10 is an innovative product which offers consumers a number of significant benefits and advantages. Foremost, this product provides consumers a safe, noninvasive and most importantly, effective alternative to undergoing a surgical facelift procedure. A specially designed accessory 10 is securely, yet discreetly adhered to the face and connected to the ears and thereby pulls the facial skin smooth and taut, resulting in the appearance of a successful facelift procedure, without requiring one to "go under the knife." Sparing the user from bruising, swelling, pain and potentially dangerous complications of having a surgical facelift performed, use of the non-invasive face-lifting accessory 10 enables consumers to enjoy the benefits of this cosmetic procedure, without enduring the associated risks.

Further, the non-invasive face-lifting accessory 10 provides a cost-effective alternative to undergoing cosmetic surgery, a benefit that should be appreciated by many during these difficult economic times. Importantly, unlike plastic surgery which renders permanent and sometimes disastrous results, the non-invasive face-lifting accessory 10 provides a temporary solution that would enable one to enjoy the appearance of a facelift, without the risk of dramatically and permanently altering their face.

Enabling the user to enjoy a more youthful and relaxed appearance, the non-invasive face-lifting accessory 10 serves to boost the user's self-esteem and confidence, resulting in a happier and thus healthier individual. Considering that in today's society so much attention is placed on physical appearances, use of a product such as the non-invasive face-lifting accessory 10 enables one to enjoy greater success in their social life and career. Although designed expressly for use by any woman or man who wishes to enjoy a more youthful appearance, application of the non-invasive face-lifting accessory 10 can prove a much demanded service at beauty salons, spas and similar establishments. Simply stated, what mother of the bride wouldn't want to look her best on her daughter's wedding day and by having the non-invasive face-lifting accessory 10 applied while her hair is professionally styled, she absolutely could.

Not limited to home or salon use, the non-invasive face-lifting accessory 10 could also be utilized by plastic surgeons, professional estheticians, dermatologists, and similar skin specialists as a means of enabling clientele to preview facelift and other skin procedure options and potential results prior to committing to a surgical procedure, as well as allowing professionals to recommend a healthy, effective and affordable treatment to their clientele. As such, the non-invasive face-lifting accessory 10 is a versatile product which serves a variety of practical uses. Simple to use, consumers should appreciate the ease of which this product could be applied.

A non-invasive face-lifting accessory 10 includes transparent and various skin-tone colored soft, flexible, hypoallergenic tape (fastener 12, tab 22), to be held in place on certain areas of the face, via a set of comfortable anchor-like earpieces for providing a non-surgical means of lifting or pulling the skin taut, creating a more youthful appearance in the face. The non-invasive face-lifting accessory 10 is a practical product which offers consumers a simple and effective way in which to treat frown lines, furrows and wrinkles via a noninvasive facelift. Easily applied, this cleverly designed accessory can be a favored addition to the skin care market.

While non-limiting exemplary embodiment(s) has/have been described with respect to certain specific embodiment(s), it will be appreciated that many modifications and changes may be made by those of ordinary skill in the relevant art(s) without departing from the true spirit and scope of the present disclosure. It is intended, therefore, by the appended claims to cover all such modifications and changes that fall within the true spirit and scope of the present disclosure. In particular, with respect to the above description, it is to be realized that the optimum dimensional relationships for the parts of the non-limiting exemplary embodiment(s) may include variations in size, materials, shape, form, function and manner of operation.

The Abstract of the Disclosure is provided to comply with 37 C.F.R. §1.72(b) and is submitted with the understanding that it will not be used to interpret or limit the scope or meaning of the claims. In addition, in the above Detailed Description, various features may have been grouped together or described in a single embodiment for the purpose of streamlining the disclosure. This disclosure is not to be interpreted as reflecting an intention that the claimed embodiment(s) require more features than are expressly recited in each claim. Rather, as the following claims reflect, inventive subject matter may be directed to less than all of the features of any of the disclosed non-limiting exemplary embodiment(s). Thus, the following claims are incorporated into the Detailed Description, with each claim standing on its own as defining separately claimed subject matter.

The above disclosed subject matter is to be considered illustrative, and not restrictive, and the appended claims are intended to cover all such modifications, enhancements, and other embodiment(s) which fall within the true spirit and scope of the present disclosure. Thus, to the maximum extent allowed by law, the scope of the present disclosure is to be determined by the broadest permissible interpretation of the following claims and their equivalents, and shall not be restricted or limited by the above detailed description.

What is claimed as new and what is desired to secure by Letters Patent of the United States is:

1. A non-invasive face-lifting accessory for non-surgically lifting and pulling a user facial skin taut, thereby creating a more youthful appearance, said non-invasive face-lifting accessory comprising:

an ear piece adapted to be positioned about an ear of the user; and a plurality of flexible fasteners detachably connected to said ear piece;

wherein said flexible fasteners are adapted to be held in place on certain areas of the user facial skin;

wherein said ear piece has a hook shape;

wherein said hook shape comprises a single and unitary body;

wherein said single and unitary body comprises a centrally registered latitudinal axis, a curvilinear top portion extending upwardly away from said centrally registered latitudinal axis, said curvilinear top portion including a substantially U-shape, and a curvilinear bottom portion extending downwardly away from said centrally registered latitudinal axis and opposite faced from said curvilinear top portion;

wherein said curvilinear bottom portion is integral with said curvilinear top portion;

wherein said single and unitary body further comprises a centrally registered longitudinal axis, a proximal end positioned at a first terminal end of said curvilinear top portion, and a distal end position at a second terminal end of said curvilinear bottom portion;

wherein said distal end is axially offset from said proximal end relative to said centrally registered longitudinal axis;

wherein said fasteners comprise a plurality of resilient, hypoallergenic tabs having an adhesive inner face capable of being removably affixed to certain areas of the user face adjacent to the user ear;

wherein each of said tabs comprises a linear first section having a proximal tip and an axially opposed distal tip, and a circular second section having a circumferential outer edge monolithically coupled to said distal tip;

wherein each of said tabs are deformably bent at said proximal tip relative to said ear piece;

wherein said tabs comprise a first tab removably reattached to said curvilinear top portion adjacent to said proximal end of said single and unitary body, and a second tab removably reattached to said curvilinear bottom portion at said distal end of said single and unitary body;

wherein said tabs further comprise a third tab removably reattached to said curvilinear top portion approximately diametrically opposed to said proximal end of said single and unitary body;

wherein said third tab extends oppositely away from said first tab;

wherein said first tab is coextensively shaped to said second tab and said third tab.

2. A non-invasive face-lifting accessory for non-surgically lifting and pulling a user facial skin taut, thereby creating a more youthful appearance, said non-invasive face-lifting accessory comprising:

an ear piece adapted to be positioned about an ear of the user; and a plurality of flexible fasteners detachably connected to said ear piece;

wherein said flexible fasteners are adapted to be held in place on certain areas of the user facial skin;

wherein said flexible fasteners are arranged in a non-overlapping configuration relative to said ear piece;

wherein said ear piece has a hook shape;

wherein said hook shape comprises a single and unitary body;

wherein said single and unitary body comprises a centrally registered latitudinal axis, a curvilinear top portion extending upwardly away from said centrally registered latitudinal axis, said curvilinear top portion including a substantially U-shape, and a curvilinear bottom portion extending downwardly away from said centrally registered latitudinal axis and opposite faced from said curvilinear top portion;

wherein said curvilinear bottom portion is integral with said curvilinear top portion;

wherein said single and unitary body further comprises a centrally registered longitudinal axis, a proximal end positioned at a first terminal end of said curvilinear top portion, and a distal end position at a second terminal end of said curvilinear bottom portion;

wherein said distal end is axially offset from said proximal end relative to said centrally registered longitudinal axis;

wherein said fasteners comprise a plurality of resilient, hypoallergenic tabs having an adhesive inner face capable of being removably affixed to certain areas of the user face adjacent to the user ear;

wherein each of said tabs comprises a linear first section having a proximal tip and an axially opposed distal tip, and a circular second section having a circumferential outer edge monolithically coupled to said distal tip;

wherein each of said tabs are deformably bent at said proximal tip relative to said ear piece;

wherein said tabs comprise a first tab removably reattached to said curvilinear top portion adjacent to said proximal end of said single and unitary body, and a second tab removably reattached to said curvilinear bottom portion at said distal end of said single and unitary body;

wherein said tabs further comprise a third tab removably reattached to said curvilinear top portion approximately diametrically opposed to said proximal end of said single and unitary body;

wherein said third tab extends oppositely away from said first tab;

wherein said first tab is coextensively shaped to said second tab and said third tab.

* * * * *